US006520822B2

(12) United States Patent
Kennedy

(10) Patent No.: US 6,520,822 B2
(45) Date of Patent: Feb. 18, 2003

(54) BUBBLE TOY CONTAINER WITH SOLUTION-FED AND SPILL-RESISTANT BUBBLE WAND

(76) Inventor: Daniel J. Kennedy, 7020 Captain Kidd Ave. #10, Sarasota, FL (US) 34231

( * ) Notice: Subject to any disclaimer, the term of this patent is extended or adjusted under 35 U.S.C. 154(b) by 0 days.

(21) Appl. No.: 10/167,822

(22) Filed: Jun. 12, 2002

(65) Prior Publication Data

US 2002/0187716 A1 Dec. 12, 2002

Related U.S. Application Data

(60) Provisional application No. 60/297,498, filed on Jun. 12, 2001.

(51) Int. Cl.[7] ..... A63H 33/28
(52) U.S. Cl. ..... 446/15; 446/20
(58) Field of Search ..... 446/15–21; D21/401–402

(56) References Cited

U.S. PATENT DOCUMENTS

| | | | | | |
|---|---|---|---|---|---|
| 2,587,535 | A | | 2/1952 | Scott | 46/8 |
| 2,720,723 | A | * | 10/1955 | Peretti | |
| 2,853,829 | A | | 9/1958 | Greene | 46/8 |
| 2,858,639 | A | * | 11/1958 | Lawrence | |
| 3,579,898 | A | | 5/1971 | Hein | 46/7 |
| 3,604,144 | A | | 9/1971 | Span | 46/7 |
| 3,736,694 | A | | 6/1973 | Lebensfeld | 46/7 |
| 3,775,898 | A | | 12/1973 | Kalish | 46/7 |
| 3,775,899 | A | | 12/1973 | Wolf | 46/7 |
| 3,818,627 | A | | 6/1974 | Lebensfeld | 46/7 |
| 3,848,355 | A | | 11/1974 | Weight | 46/7 |
| 4,044,496 | A | | 8/1977 | Jernstrom | 46/7 |
| 4,133,138 | A | | 1/1979 | Coons | 46/6 |
| 4,246,717 | A | | 1/1981 | Wachtel | 46/6 |
| 4,867,724 | A | | 9/1989 | Sheng | 446/17 |
| 4,869,390 | A | | 9/1989 | Kennedy | 220/90.4 |
| 5,042,819 | A | | 8/1991 | LaFata | 273/349 |
| 5,135,422 | A | | 8/1992 | Bowen | 446/15 |
| 5,304,085 | A | | 4/1994 | Novak | 446/15 |
| 5,653,620 | A | * | 8/1997 | Lin | 446/15 |
| 5,704,821 | A | | 1/1998 | Mann | 446/16 |
| 5,839,936 | A | | 11/1998 | Lin | 446/16 |
| 6,287,165 | B1 | * | 9/2001 | Lin | 446/16 |
| 6,406,347 | B2 | * | 6/2002 | Swagel et al. | 446/16 |
| 6,422,974 | B1 | * | 7/2002 | Schimmel | 482/44 |

* cited by examiner

*Primary Examiner*—Derris H. Banks
*Assistant Examiner*—Jamila Williams
(74) *Attorney, Agent, or Firm*—Weingarten, Schurgin, Gagnebin & Lebovici LLP

(57) ABSTRACT

A bubble toy that minimizes spillage has a retaining mechanism disposed below a bubble ring or rings on a bubble wand to prevent the wand from being lifted completely out of the container. A solution feed section provided above the bubble ring or rings has a plurality of channels arranged to feed bubble solution downwardly to the bubble ring or rings. An articulating joint may be provided between each of the bubble rings by which the bubble rings are able fold or collapse within the container, thereby allowing use of a longer wand. A bubble wand is provided with a spill-resistant container on an end opposite the bubble ring or rings.

21 Claims, 3 Drawing Sheets

BUBBLE TOY CONTAINER WITH SOLUTION-FED AND SPILL-RESISTANT BUBBLE WAND

CROSS REFERENCE TO RELATED APPLICATIONS

This application claims the benefit under 35 U.S.C. § 119(*e*) of U.S. Provisional Patent Application No. 60/297,498, filed on Jun. 12, 2001, the disclosure of which is incorporated by reference herein.

STATEMENT REGARDING FEDERALLY SPONSORED RESEARCH OR DEVELOPMENT

N/A

BACKGROUND OF THE INVENTION

Blowing bubbles is a popular activity for children. Commonly, a bubble forming solution is stored in a small container. A wand having a ring formed at one end of a wand shaft is housed loosely in the container. The container is closed with a screw cap.

To blow bubbles, the user, often a child, removes the cap and inserts a finger into the container to retrieve the wand. Retrieving the wand can be difficult, particularly if the container is small, and messy, as one or more fingers often contact the bubble solution. Once the wand has been retrieved, the end opposite the ring is grasped in one hand. The ring is dipped into the solution in the container and lifted out coated with the solution. The wand is lifted near the user's lips, and the user blows air through the ring to produce the bubbles. This process may be repeated as often as desired until the bubble solution is depleted.

Blowing bubbles in this way is usually messy and wasteful, because the solution drips down the wand onto the fingers and the ground. Also, the container can be easily tilted sufficiently to spill solution.

SUMMARY OF THE INVENTION

The present invention relates to a bubble toy that minimizes spillage of bubble solution. In one embodiment, a bubble wand is attached at an upper end to a closure of a bubble solution container. One or more bubble rings are disposed below the wand shaft. A retaining mechanism disposed below the bubble ring(s) prevents the wand from being lifted completely out of the container. A solution feed section provided above the bubble ring(s) has a plurality of channels arranged to feed bubble solution downwardly to the bubble ring or rings. In use, a child pulls the wand upwardly out of the container until the retaining mechanism abuts the top of the container and blows bubbles through the rings, preferably through the lowermost ring to allow the solution feed section to feed the rings with solution. Excess bubble solution on the rings drips downwardly into the container rather than onto the hands, the ground, or elsewhere. Because both hands of the child are used and located at the container, the child's focus is directed more closely at the container, resulting in less likelihood of spillage due to tipping of the container.

In another embodiment, an articulating joint may be provided between each of the bubble rings by which the bubble rings are able fold or collapse within the container, thereby allowing use of a longer wand.

In a further embodiment, a bubble wand is provided with a spill-resistant container on an end opposite the bubble ring or rings. The spill-resistant container includes a reservoir and a closure. The closure has an opening therein with a tubular member depending from the opening to provide a passage into the reservoir. The wand shaft extends through the passage and spaced from the tubular member to allow bubble solution to flow down the shaft and into the reservoir, not onto the child's hands, the ground, or elsewhere. The container traps the solution so that the wand may be inserted back into the bubble solution container to be refilled and the solution in the spill-resistant container will not come out.

DESCRIPTION OF THE DRAWINGS

The invention will be more fully understood from the following detailed description taken in conjunction with the accompanying drawings in which.

DETAILED DESCRIPTION OF THE INVENTION

Figure 1:
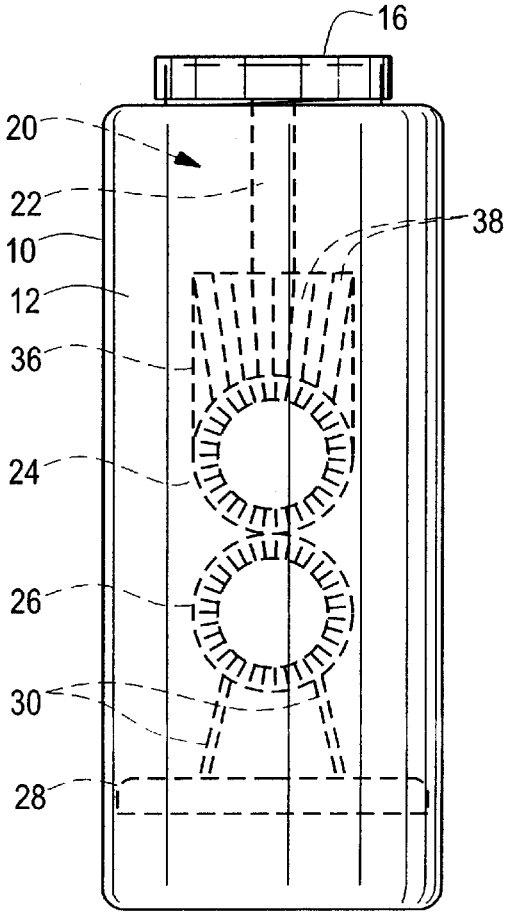
FIG. 1 is a side view of a first embodiment of a bubble toy container according to the present invention.
Figure 2:
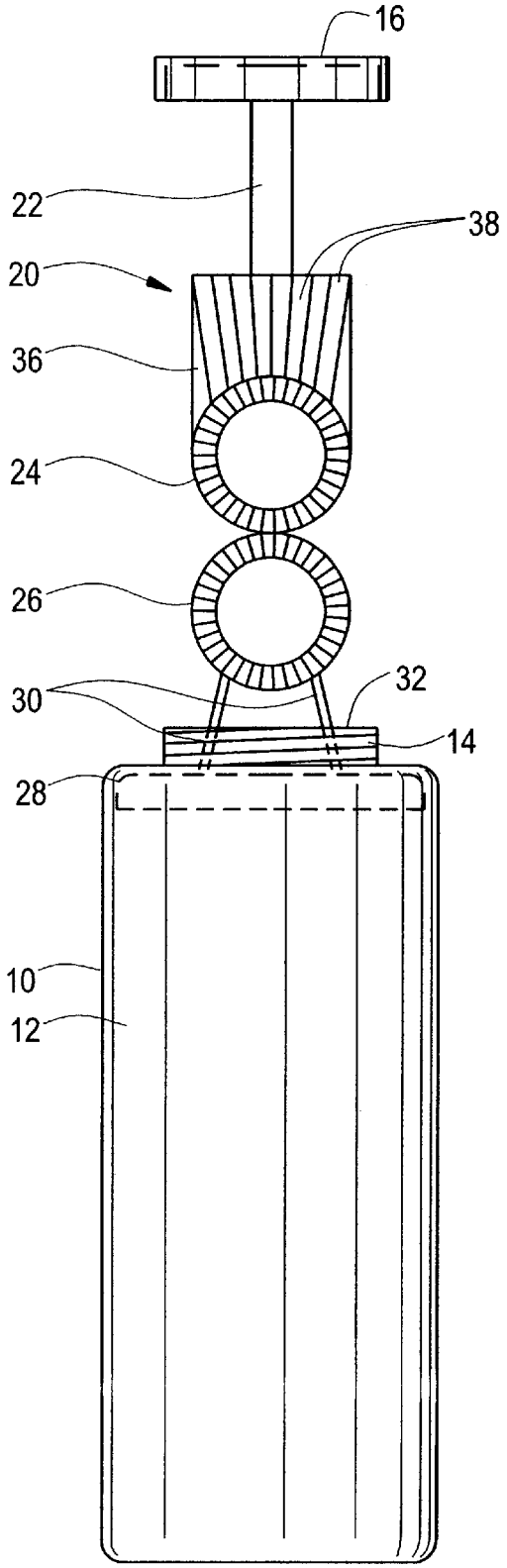
FIG. 2 is a side view of the bubble toy container of FIG. 1 in an opened position for use.

A first embodiment of a bubble toy container according to the invention is illustrated in FIGS. 1 and 2. In this embodiment, the container 10 includes a reservoir 12 for holding a bubble solution having an opening 14 at the top. The opening is closable with a suitable closure 16, such as a screw-on cap, that includes a bubble wand 20 fastened thereto. The bubble wand depends from the cap and is stored inside the reservoir. The wand may be formed with or fastened to the cap in any suitable manner, such as by adhesive, integrally molded with the cap, or in any other manner as would be known in the art.

The bubble wand 20 includes a wand shaft 22 having one or more rings 24, 26 thereon that capture a film of bubble solution stored in the container 10. Preferably, two rings 24, 26 are provided on the shaft 22, although one or another number of rings may be provided. The rings are preferably ribbed, as known in the art. A retaining mechanism 28 is provided at the end of the wand 20 opposite the cap 16. In the embodiment illustrated, the retaining mechanism has the form of a disc or ring that is wider than the opening at the top of the reservoir, thereby preventing the wand from being completely removed from the reservoir. Preferably, the retaining mechanism should have a sufficiently open area(s) to provide minimal resistance to movement through the solution. The retaining mechanism 28 is attached to the lowermost bubble ring with one or more spacing elements 30 sufficient to ensure that the lowermost bubble ring 26 can be lifted above the top edge 32 of the container. The spacing elements 30 can be flexible or rigid members. It will be appreciated that the retaining mechanism 28 and spacing element(s) 30 may have a variety of configurations, as one skilled in the art may readily determine. The retaining mechanism and spacing element(s) may be formed with or fastened to the wand 20 in any suitable manner, such as by adhesive, integrally molded with the wand, or in any other manner as would be known in the art.

The wand preferably includes an integral or otherwise attached bubble solution feed section 36 above the rings 24, 26. The feed section is formed with a plurality of channels or ribs 38 that capture additional bubble solution. When the wand is extended from the reservoir 12, the solution on the feed section 36 is fed to the lower rings 24, 26. Thus, by blowing bubbles through the bottom ring 26 first, more bubbles may be produced as the solution continuously runs down from the feed section 36 and the upper ring 24. The solution that flows down the rings returns to the reservoir 12, not onto the hands of a user, usually a child, or elsewhere.

In use, the child holds the container 10 with one hand and unscrews the cap 16 and pulls the cap upwardly with the other hand until the wand 20 extends out of the reservoir. The retaining mechanism 28 prevents the child from completely removing the wand from the reservoir. The child may then blow bubbles through the rings in the wand, preferably through the lower ring 26 to allow the solution feed process to continuously feed the lower ring with solution. Excess bubble solution on the rings drips downwardly into the container 10 rather than onto the child's hands, the floor, the ground, or elsewhere. The child inserts the wand downwardly back into the container to refill the rings with bubble solution. Also, because the wand is not removable from the container, both hands of the child are used and located at or near the container and the child's focus is directed more closely at the container, resulting in less likelihood of spillage due to tipping of the container.

Figure 3:
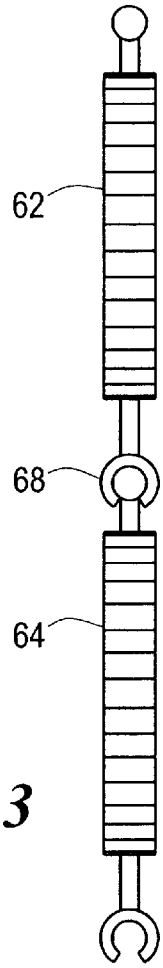
FIG. 3 is a side view of a further embodiment of an articulated wand according to the present invention.
Figure 4:
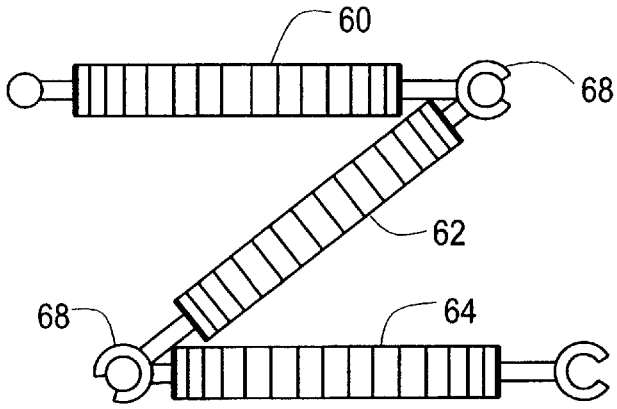
FIG. 4 is a side view of the articulated wand of FIG. 3 in a collapsed or folded configuration.

A further embodiment of a portion of a bubble wand is illustrated in FIGS. 3 and 4. The rings 60, 62, 64 of the wand are connected at articulated joints 68 to allow the wand to collapse partially or fully within the container during storage. In this manner, a longer wand can be fitted within the container.

Figure 7:
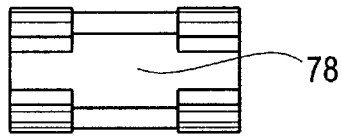
FIG. 7 is a top view of the socket of the bubble ring of FIG. 5.
Figure 5:
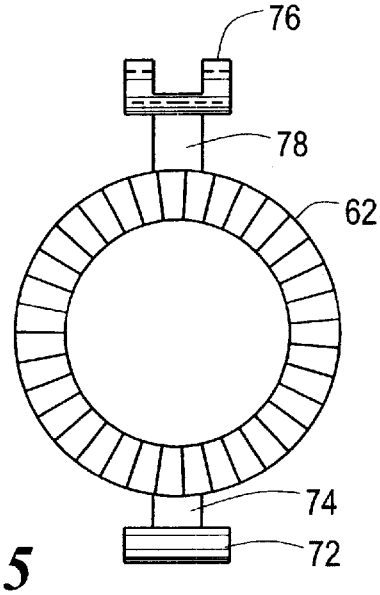
FIG. 5 is a front view of a bubble ring with a cylinder and socket hinge configuration.
Figure 6:
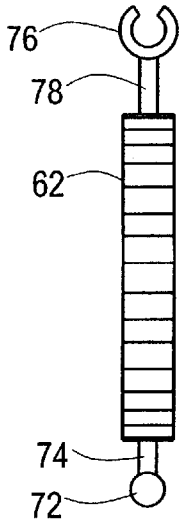
FIG. 6 is a side view of the bubble ring of FIG. 5.

The joint 68 between the rings can be formed in any suitable manner. For example, referring to FIGS. 5–7, a hinge may be provided, in which a cylinder 72 on a short post 74 extends from one side of the ring 62 and a socket 76 on a short post 78 shaped to cooperatively receive the cylinder 72 extends from the diametrically opposite side of the ring 62. The cylinder 72 is pivotable within the socket 76 to allow the rings to fold or collapse in an accordion fashion, as shown in FIG. 4. With this type of configuration, any desired number of rings can be attached in series. The topmost ring may be attached to the wand shaft or feed section either rigidly or with an articulating joint (not shown). It will be appreciated that other joint configurations, such as a ball and socket, may be used.

Figure 8:
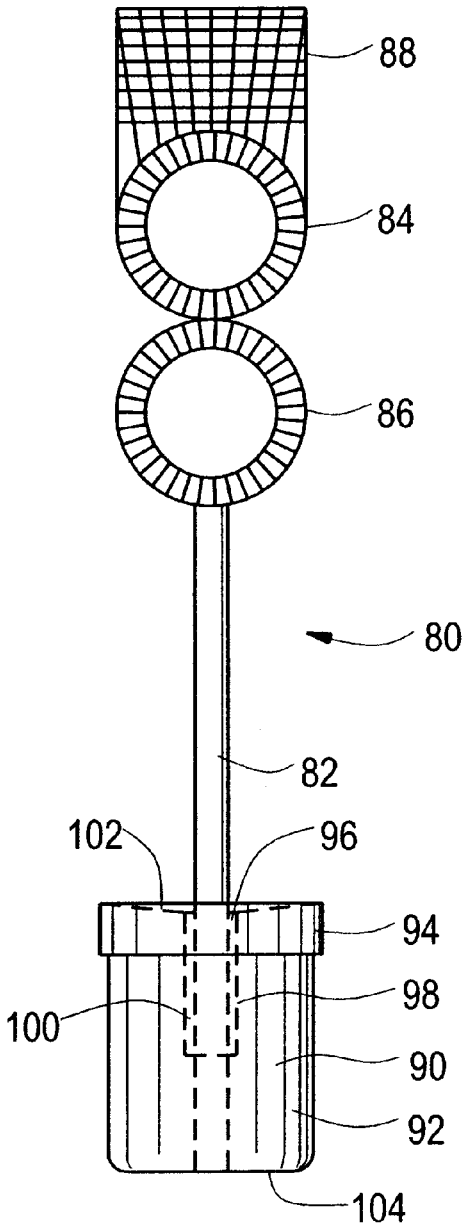
FIG. 8 is a side view of a further embodiment of a bubble wand with a spill-resistant container according to the present invention.

A further embodiment of a bubble wand 80 is illustrated in FIG. 8. In this embodiment, the bubble wand shaft 82 is provided at one end with one or more rings 84, 86 and preferably an integral or otherwise attached feed section 88 as described above in conjunction with FIGS. 1 and 2. The wand also includes a spill-resistant container 90 at an opposite end The bubble wand 80 is filled from a separate bubble solution container, such as the container 10 illustrated in conjunction with the embodiment of FIG. 1

More particularly, the spill-resistant container 90 includes a generally cylindrical reservoir 92 and a closure 94. The closure is preferably removable, such as a screw-on or snap-on cap. The cap has an opening 96 therein with a tubular member 98 depending from the opening to provide a passage 100 into the reservoir 92. The tubular member depends a suitable distance, such as approximately half way, into the reservoir to prevent solution from flowing out through the opening 96 when the reservoir is tipped. The shaft 82 of the wand extends through the passage 100 in the tubular member 98 into the reservoir. The wand is spaced from the tubular member to allow bubble solution to flow down the shaft and into the reservoir through the passage in the tubular member. The surface 102 of the cap is preferably sloped to further direct solution spilled thereon through the opening. The wand is fastened to or formed with the reservoir or the cap in any suitable manner, as would be known in the art. For example, the wand may be attached to the bottom floor 104 of the reservoir, as with adhesive or by molding therewith.

To blow bubbles, a child holds the wand 80 at the spill-resistant container 90, dips the wand into the separate bubble solution container to fill or coat the wand, removes the wand from the bubble solution container, and holds the wand with the feed section 88 up and the container 90 at the bottom. Bubble solution that is not blown into bubbles flows down the rings 84, 86 onto the shaft 82 and through the passage 100 in the tubular member 98 into the spill-resistant container 90 at the bottom of the wand, not onto the child's hands, the floor, or elsewhere. The container traps the solution therein, so that it does not run out when the wand is tipped Thus, the wand may be inserted back into the separate bubble solution container to be refilled and the solution in the spill-resistant container 90 will not come out.

Figure 9:
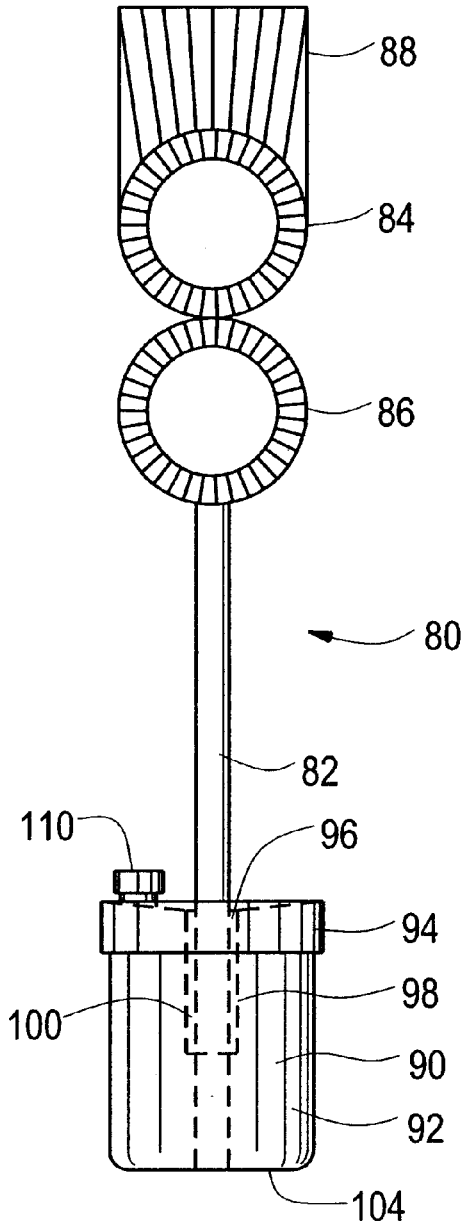
FIG. 9 is a side view of a still further embodiment of a bubble wand with a spill-resistant container according to the present invention.

The spill-resistant container 90 can be emptied by removing the closure 94 and pouring the contents out of the reservoir 92. A removable cap 94 is preferred to allow the container to be more readily rinsed clean between uses. In a further embodiment, illustrated in FIG. 9, an aperture having a plug 110 or other closure member therein may be provided in the cap 94 to facilitate emptying of the reservoir if desired.

The bubble toys of the present invention result in less spillage of bubble solution and more bubbles, providing more fun to the child. The bubble toys can also be used in conjunction with an electric or battery driven motor for blowing bubbles. The invention is not to be limited by what has been particularly shown and described, except as indicated by the appended claims.

What is claimed is:

1. A bubble blowing toy comprising:

a container having a reservoir for holding bubble solution and an opening at a top end, and a closure configured to close the opening in the container; and a bubble wand comprising:

a wand shaft having an upper end and a lower end, the upper end of the wand shaft attached to the closure, at least one bubble ring configured to capture a film of bubble solution and disposed at the lower end of the wand shaft, and a retaining mechanism disposed below the bubble ring, the retaining mechanism being larger than the opening in the container, whereby the retaining mechanism is retained within the container.

2. The bubble toy of claim 1, further comprising a solution feed section between the bubble ring and the lower end of the wand shaft, the solution feed section having a plurality of channels thereon arranged to feed bubble solution to the bubble ring.

3. The bubble toy of claim 1, further comprising a plurality of bubble rings configured to capture a film of bubble solution disposed serially along the wand.

4. The bubble toy of claim 3, further comprising an articulating joint between each of the plurality of bubble rings, the articulating joint allowing the bubble rings to fold within the container.

5. The bubble toy of claim 4, wherein the articulating joint comprises a joint member extending from one side of one of the rings and a cooperative joint member extending from another side of an adjacent one of the rings.

6. The bubble toy of claim 4, wherein the articulating joint comprises a joint member extending from one side of one of the rings and a cooperative joint member extending from a diametrically opposite side of the one of the rings.

7. The bubble toy of claim 4, wherein the articulating joint comprises a socket formed on one of the rings and a cylinder formed on another of the rings rotatably received in the socket.

8. The bubble toy of claim 3, wherein the retaining mechanism is attached to a lowermost bubble ring of the plurality of bubble rings.

9. The bubble toy of claim 1, wherein the retaining mechanism comprises a disk having a diameter larger than a diameter of the opening in the container.

10. The bubble toy of claim 1, wherein the retaining mechanism is attached to the bubble ring with a spacer element sized to allow the bubble ring to be lifted out of the container and clear of the opening.

11. The bubble toy of claim 10, wherein the spacer element comprises at least one flexible member.

12. The bubble toy of claim 10, wherein the spacer element comprises at least one rigid member.

13. A bubble blowing toy comprising:

a container having a reservoir for holding bubble solution and an opening at a top end, and a closure configured to close the opening in the container; and a bubble wand comprising:

a wand shaft having an upper end and a lower end, the upper end of the wand shaft attached to the closure, a plurality of bubble rings configured to capture a film of bubble solution and disposed at the lower end of the wand shaft, and an articulating joint between each of the plurality of bubble rings, the articulating joint allowing the bubble rings to fold within the container.

14. The bubble toy of claim 13, wherein the articulating joint comprises a joint member extending from one side of one of the rings and a cooperative joint member extending from another side of an adjacent one of the rings.

15. The bubble toy of claim 13, wherein the articulating joint comprises a joint member extending from one side of one of the rings and a cooperative joint member extending from a diametrically opposite side of the one of the rings.

16. The bubble toy of claim 13, wherein the articulating joint comprises a socket formed on one of the rings and a cylinder formed on another of the rings rotatably received in the socket.

17. A bubble wand for use with a bubble toy comprising:

a wand shaft;

at least one bubble ring configured to capture a film of bubble solution disposed at one end of the wand shaft;

a solution feed section attached to the bubble ring on a side opposite the wand shaft, the solution feed section having a plurality of channels thereon arranged to feed bubble solution to the bubble ring; and a spill-resistant container disposed at an opposite end of the wand shaft, the container comprising a reservoir and a closure, the closure having an opening therein and a tubular member depending from the opening into the reservoir to provide a passage into the reservoir, the wand shaft extending through and spaced radially inwardly from the passage, whereby bubble solution on the wand runs into the reservoir through the passage.

18. The bubble wand of claim 17, wherein the closure is removable.

19. The bubble wand of claim 17, wherein the closure includes an outer surface sloped to direct solution toward the passage.

20. The bubble wand of claim 17, further comprising an aperture in the closure and a removable plug disposed in the aperture in the closure.

21. The bubble wand of claim 17, wherein the tubular member extends approximately half way into the reservoir.

* * * * *